United States Patent [19]

Findlay

[11] Patent Number: 5,031,902

[45] Date of Patent: Jul. 16, 1991

[54] ROTARY MOTION TRANSMISSION SYSTEM FOR EXERCISE BICYCLE

[76] Inventor: Nathanial B. Findlay, 1045 Belvedere Ave., Apt. #226, Quebec, Quebec, Canada, G1N 4L4

[21] Appl. No.: 568,035

[22] Filed: Aug. 16, 1990

[51] Int. Cl.[5] ..... A63B 21/00

[52] U.S. Cl. ..... 272/73

[58] Field of Search ..... 272/73, 128, 72, 71

[56] References Cited

U.S. PATENT DOCUMENTS

| | | | |
|---|---|---|---|
| 3,964,742 | 6/1976 | Carnielli | 272/73 |
| 4,452,445 | 6/1984 | Csekes | 272/73 |
| 4,533,136 | 8/1985 | Smith et al. | 272/73 |
| 4,632,386 | 12/1986 | Beech | 272/73 |
| 4,705,493 | 11/1987 | Lin | 474/69 |
| 4,789,153 | 12/1988 | Brown | 272/73 |
| 4,809,970 | 3/1989 | Bietegui | 272/73 |

*Primary Examiner*—Stephen R. Crow

*Attorney, Agent, or Firm*—Foley & Lardner

[57] ABSTRACT

The exercise bicycle includes pedals and a fly wheel, and the axes of the pedals are spaced from the axis of the fly wheel. A pedal sprocket is mounted on the pedal shaft for rotation with the pedal shaft, and a fly wheel sprocket is mounted on the transmission system in operative engagement with the transmission system. A chain connects the two sprockets. The rotary motion transmission system, which is operatively connected with the fly wheel sprocket, comprises a planetary gear arrangement.

4 Claims, 2 Drawing Sheets

ROTARY MOTION TRANSMISSION SYSTEM FOR EXERCISE BICYCLE

BACKGROUND OF INVENTION

1. Field of the Invention

The invention relates to a rotary motion transmission system for a stationary exercising bicycle. More specifically, the invention relates to such a transmission system for a stationary exercising bicycle which includes pedals and a fly wheel, the rotary motion of the pedals being transmitted to the fly wheel by the rotary motion transmission system which comprises a planetary gear arrangement.

2. Description of Prior Art

Stationary bicycles are known in the art as is illustrated in, for example, U.S. Pat. No. 4,452,445, Csekes, June 5, 1984, U.S. Pat. No. 3,964,742, Carnielli, June 22, 1976, U.S. Pat. No. 4,533,136, Smith et al, Aug. 6, 1985, U.S. Pat. No. 4,705,493, Lin, Nov. 10, 1987, U.S. Pat. No. 4,809,970, Beistegui, Mar. 7, 1989, U.S. Pat. No. 4,632,386, Beech, Dec. 30, 1986 and U.S. Pat. No. 4,789,153, Brown, Dec. 6, 1988.

In the Csekes patent, and referring to FIG. 1 thereof, the drum wheel 21 is equivalent to the ring gear of a planetary gear assembly. The drum wheel is connected, via free wheel 20 to shaft 5 which is connected to pedals 8 and 9. Thus, the drum wheel 21 will rotate with the rotation of the pedals. Rotation of the drum wheel causes rotation of pinion or planet gears 22, 23 and 24 (see also FIG. 2) about their own axis. Because of the engagement of the planet gears with the inner shaft 10 to the portion 26, rotation of the planet gears will cause the inner shaft 10 to rotate. Inner shaft 10 is connected to fly wheel 15. Thus, rotation of the pedals will cause rotation of the fly wheel 15.

In the Csekes arrangement, the fly wheel is coaxial with the pedal shaft and sits below the body of the exerciser and between his legs. Accordingly, unless he makes a special effort to do so, the exerciser cannot see the rotation of the fly wheel.

It has been found that exercisers prefer to see the motion of the fly wheel as this is an indication of their efforts.

The Carnielli patent also uses a planetary gear assembly which is illustrated in FIG. 5 of the patent and includes a central gear 58. Although there is very little description of how the planetary gear operates in the Carnielli patent, from FIGS. 1 and 3 it would appear that the shaft of the pedals is connected to the shaft of the central gear 58. Thus, rotation of the pedals would cause rotation of the carrier which is presumably connected to the fly wheel 62 of FIG. 3. Once again, in the Carnielli patent, the fly wheel is coaxial with the shaft of the pedals and sits under the exerciser between his legs. Thus, it suffers the same defects as the Csekes arrangement.

Smith et al teaches an arrangement wherein the pedals rotate about a horizontal axis whereas the fly wheel 84 rotates about a vertical axis. The patent also teaches an arrangement for transmitting the rotation of the pedals to the fly wheel.

In Lin, the transmission of the rotary motion from the pedals to the fly wheel is effected without any gears. Instead, there are a plurality of drive wheels and connecting chains which effect the transmission.

Beistegui teaches an arrangement wherein the shaft 2 of the pedals 15 is connected directly to the fly wheel 1 so that the fly wheel rotates directly with the rotation of the pedals. Rotation of the fly wheel causes rotation of the gear 5 which in turn causes rotation of gear 13. The purpose of the extra gears is to provide extra drag so that the fly wheel appears heavier than it actually is. In this patent, the fly wheel is, once again, beneath the exerciser and between his legs.

Beech also teaches an arrangement using a planetary gear for transmitting the rotation of the pedals to rotation of a fly wheel. In Beech, as in Carnielli, the shaft of the pedals is connected to the central gear. Also, in Beech, the fly wheel is beneath the exerciser and between his legs so it would not be immediately visible to an exerciser even if the casing 16 did not exist.

Brown teaches an arrangement wherein the fly wheel is not coaxial with the axis of the pedals. However, Brown teaches a rather complex transmission arrangement, illustrated in FIG. 15, and including an extra toothed wheel 636.

SUMMARY OF INVENTION

It is therefore an object of the invention to provide a stationary exercising bicycle which overcomes the limitations of the prior art.

It is a more specific object of the invention to provide a stationary exercising bicycle including pedals and a fly wheel wherein the fly wheel is spaced from the pedals so as to be easily visible to an exerciser.

It is a more specific object of the invention to provide such an exercise bicycle wherein the rotary motion of the pedals is transmitted to the fly wheel by a planetary gear arrangement.

In accordance with the invention there is provided a rotary motion transmission system for a stationary exercising bicycle;

said bicycle comprising:

a stationary support stand;

pedal means supported by said support stand, said pedal means including a rotatable shaft and a toothed pedal sprocket means mounted on said shaft for rotation therewith;

a fly wheel means supported by said support stand in spaced relationship with said pedal means, said fly wheel means comprising a fly wheel sprocket means connected in operative relationship with said fly wheel means;

said pedal sprocket means being connected to said fly wheel sprocket means by chain means;

said rotary motion transmission system comprising a planetary gear arrangement connected in operative relationship between said fly wheel sprocket means and said fly wheel;

whereby, when said fly wheel sprocket means is rotated by the rotary motion of said pedal sprocket means whose rotation is caused by the rotation of said pedal means, the rotary motion of said pedal means is transmitted to said fly wheel means.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
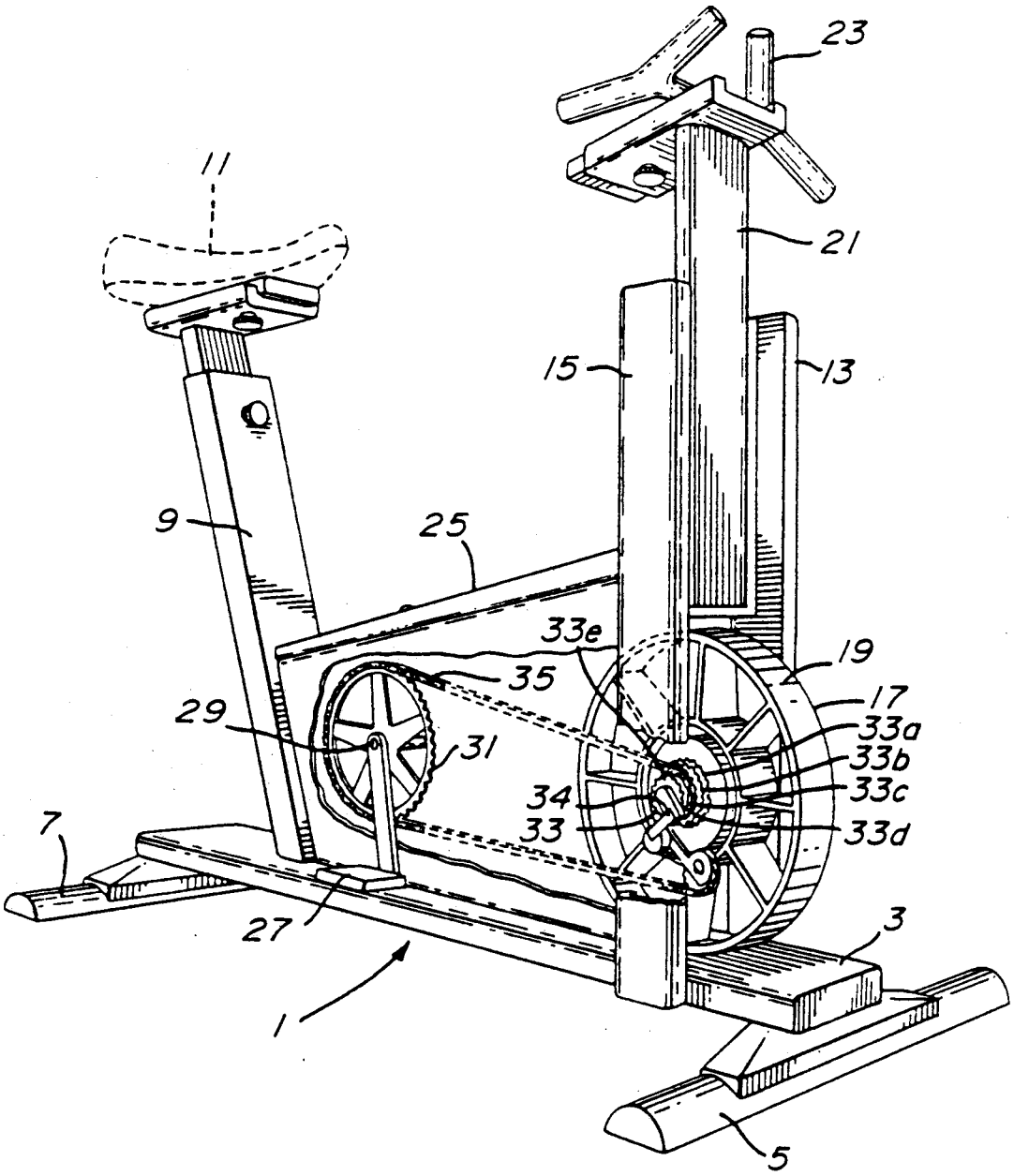
FIG. 1 is a perspective view of one embodiment of the invention including a cut-away section to show a portion of the transmission system.

Referring to FIG. 1, the stationary exercising bicycle comprises a support stand, illustrated generally at 1, and including an elongated horizontal bar 3. Stabilizer cross bars 5 and 7 extend transversely to the horizontal support bar 3 and provide stability for the exercising bicycle when it stands on the floor.

Extending upwardly from the horizontal support bar adjacent one end thereof is a seat post 9 which supports a seat 11. Extending upwardly from the elongated horizontal support bar 3 adjacent the other end thereof are a pair of fly wheel support posts 13 and 15 supporting between them a fly wheel arrangement, illustrated generally at 17, and being encased by a cage 19. The fly wheel support posts 13 and 15 also support an upwardly extending handle post 21 which supports handles 23.

A central structure, extending between post 9 and post 21, supports pedals 27 connected by a pedal shaft 29. Connected to the shaft 29, for rotation therewith, is a pedal toothed sprocket means 31. A fly wheel toothed sprocket means comprising, in the illustrated embodiment, sprocket assembly 33 is connected to the main shaft of the fly wheel arrangement as will be described in association with the description of FIG. 2. Chain 35 is mounted on toothed sprocket means 31 and 33 so that toothed sprocket means 33 will rotate with the rotation of toothed sprocket means 31, that is, with the rotation of the pedals.

The toothed sprocket assembly 33 comprises, as is well known in the art, a series of different diameter sprocket wheels 33*a*, 33*b* . . . 33*e* which are coaxially mounted on the main shaft of the flywheel arrangement, of the sprocket wheels 33*a*, 33*b* . . . 33*e* to thereby vary the gear ratio. The entire arrangement of 33 and 34 is similar to well known arrangements used on variable speed bicycles so that no further description thereof is required.

Figure 2:
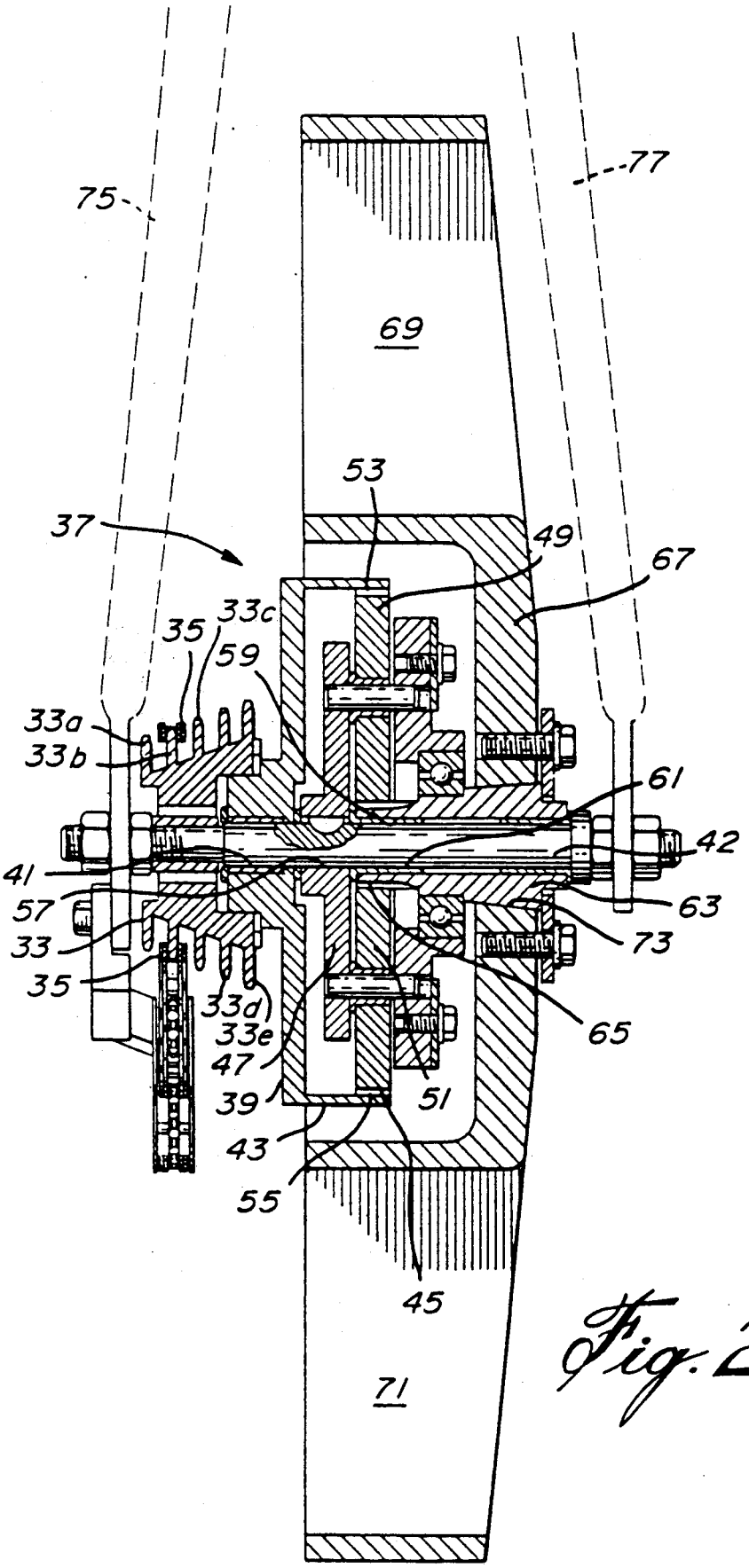
FIG. 2 is a cross-section through the fly wheel and the transmission system illustrating how the transmission system operates.

Turning now to FIG. 2, the planetary gear arrangement, illustrated generally at 37, includes a ring gear 39 having a central opening 41 through which a main shaft 42 extends. The ring gear also includes an outer circular ring member 43 having teeth 45 on the inner surface thereof.

A circular carrier 47 supports pinion gears 49 and 51 which have teeth 53 and 55 respectively on the outer surface thereof. Although only two pinion gears are shown in FIG. 2, usually the carrier will support three pinion gears which are equally spaced around the circular carrier. The circular carrier 47 also includes a central opening 57 through which main shaft 42 also extends.

Central gear 59, having a central opening 61 through which main shaft 42 extends, and an extension portion 63, has teeth 65 on the outer surface thereof. The fly wheel, illustrated generally at 67, includes vanes 69 and 71 and has a central opening 73. Although only two vanes are illustrated in FIG. 2, normally a fly wheel will include a plurality of anywhere from 6 to 10 vanes and preferably 8.

As can be seen in FIG. 2, the fly wheel sprocket, illustrated schematically at 33, is connected to the ring gear 39 so that the ring gear will rotate with the rotation of the sprocket 33. Pedal sprocket 31 and fly wheel sprocket 33 rotate in the same direction as the rotation of the pedals, so that ring gear 39 will also rotate in the same direction as the direction of the pedals.

Rotation of ring gear 39 causes the pinion gears to rotate about their own axes in the same direction as the rotation of the ring gear, and rotation of the pinion gears causes rotation of the central gear in a direction opposite to the direction of the rotation of the pedals.

The ring gear is mounted on the main shaft 42 for rotation relative to the main shaft 42, i.e., the shaft does not rotate with the rotation of the ring gear, and the ring gear does not rotate with the rotation of the main shaft 42. Central gear 59 is mounted on the main shaft for rotation with the main shaft, and fly wheel 67 is mounted on the extension 63 of the central gear 59 for rotation with the extension 63 so that the fly wheel rotates with the rotation of the central gear. Accordingly, when the pedals are rotated, the fly wheel will rotate in a direction opposite to the rotation of the pedals.

Fly wheel sprocket 33 is schematically illustrated in FIG. 2 to represent a plurality of parallel sprocket wheels of decreasing diameter from the inside to the outside. Chain 35 can be moved from one sprocket wheel to the other whereby to change the transmission ratio of the arrangement.

Although in the above-described description, the arrangement as illustrated in FIG. 2 is incorporated in a permanent arrangement such as illustrated in FIG. 1, it is also within the scope of the invention to provide an arrangement as illustrated in FIG. 2 as a separate unit for attachment to a road bicycle. To use this arrangement, the rear wheel of the bicycle would be removed and replaced with the arrangement illustrated in FIG. 2. The chain of the bicycle would be mounted on the sprocket means 33. The bicycle would then be put on a stand, which could be specially constructed for this purpose, and the road bicycle could then be used as a stationary exercising bicycle. In FIG. 2, the arrangement is illustrated as being connected between the legs 75 and 77 of the fork at the back of the bicycle.

In the latter arrangement, the bicycle frame itself would become the stationary support stand which, as will be obvious, supports both the pedal means and the fly wheel means.

Although several embodiments have been described, this was for the purpose of illustrating, but not limiting, the invention. Various modifications, which will come readily to the mind of one skilled in the art, are within the scope of the invention as defined in the appended claims.

I claim:

1. A rotary motion transmission system for a stationary exercising bicycle;

said bicycle comprising:

a stationary support stand;

pedal means supported by said support stand, said pedal means including a rotatable shaft and a toothed pedal sprocket means mounted on said shaft for rotation therewith;

a fly wheel means supported by said support stand in spaced relationship with said pedal means, said fly wheel means comprising a fly wheel sprocket means connected in operative relationship with said fly wheel means;

said pedal sprocket means being connected to said fly wheel sprocket means by chain means;

said rotary motion transmission system comprising a planetary gear arrangement connected in operative relationship between said fly wheel sprocket means and said fly wheel;

said planetary gear comprising:

an outer circular ring gear having a central opening therethrough and being rotatable about a ring gear axis, and a ring member having teeth on the inner surface thereof;

said outer ring gear being connected to said fly wheel sprocket for rotation therewith;

a carrier gear comprising a circular carrier member, said circular carrier member being coaxial with said ring gear and having a central opening, said circular member supporting a plurality of pinion gears equally spaced therearound, said pinion gears having teeth on the outer surface thereof, said pinion gear teeth meshing with said outer gear ring teeth, said pinion gears being rotatable relative to said circular member;

a central gear having a central opening therethrough, said central gear having teeth on the outer surface thereof, said central gear teeth meshing with said pinion gear teeth, said central gear being operatively connected with said flywheel means;

whereby, rotation of said central gear will cause rotation of said flywheel means via the rotary motion of said pedal means.

2. A system as defined in claim 1 and further including a fly wheel having a central opening therethrough;

a main shaft, said main shaft extending through said outer ring gear, said circular member, said central gear and said fly wheel;

said outer ring gear being rotatable relative to said main shaft and said fly wheel being rotatable with said main shaft;

whereby, when said fly wheel sprocket is rotated, said outer ring gear rotates therewith to rotate said pinion gears, the rotation of said pinion gears causing the rotation of said central gear and said main shaft therewith, the rotation of said main shaft causing the rotation of said fly wheel;

whereby, the rotary motion of said pedal means is transmitted to said fly wheel means.

3. A system as defined in any one of claims 1 or 2 wherein said support stand comprises a central support structure for supporting said pedal means;

an elongated horizontal support bar for supporting said central support structure;

a pair of posts extending upwardly from either side of said support bar adjacent one end thereof, said pair of posts providing support for said fly wheel and said transmission system.

4. A system as defined in any one of claims 1 or 2 wherein said fly wheel sprocket means comprises a sprocket assembly comprising a plurality of different diameter sprocket wheels arranged in descending order.

* * * * *